US008272578B1

(12) United States Patent
Clark et al.

(10) Patent No.: US 8,272,578 B1
(45) Date of Patent: Sep. 25, 2012

(54) SPRINKLER WITH ADJUSTABLE ARC AND ADJUSTABLE RADIUS

(75) Inventors: Michael L. Clark, San Marcos, CA (US); Daniel E. Hunter, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 442 days.

(21) Appl. No.: 12/729,599

(22) Filed: Mar. 23, 2010

(51) Int. Cl.
*B05B 3/04* (2006.01)

(52) U.S. Cl. ..... 239/237; 239/205; 239/240; 239/242; 239/249; 239/514

(58) Field of Classification Search ..... 239/204–206, 239/237, 240, 242, 246, 247, 249, 505, 513, 239/514
See application file for complete search history.

(56) References Cited

U.S. PATENT DOCUMENTS

| | | | | |
|---|---|---|---|---|
| 4,353,506 | A * | 10/1982 | Hayes | 239/247 |
| 4,867,378 | A | 9/1989 | Kah, Jr. | 239/206 |
| 5,098,021 | A | 3/1992 | Kah, Jr. | 239/242 |
| 5,104,045 | A | 4/1992 | Kah, Jr. | 239/246 |
| 5,826,797 | A | 10/1998 | Kah, III | 239/394 |
| 7,032,836 | B2 * | 4/2006 | Sesser et al. | 239/204 |
| 7,234,651 | B2 * | 6/2007 | Mousavi et al. | 239/514 |
| 8,074,897 | B2 * | 12/2011 | Hunnicutt et al. | 239/204 |

* cited by examiner

*Primary Examiner* — Steven J Ganey
(74) *Attorney, Agent, or Firm* — Michael H. Jester

(57) ABSTRACT

A sprinkler includes a stream nozzle with a plurality of circumferentially spaced, radially extending stream forming ports. A non-rotating arc adjustment sleeve is mounted for axial movement relative to the stream nozzle to selectively block the stream forming ports to vary an arc of coverage of a plurality of streams of water ejected from the stream forming ports.

21 Claims, 18 Drawing Sheets

SPRINKLER WITH ADJUSTABLE ARC AND ADJUSTABLE RADIUS

FIELD OF THE INVENTION

The present invention relates to sprinklers used to irrigate turf and landscaping, and more particularly, to sprinklers that eject multiple individual streams of water and have an adjustable arc of coverage.

BACKGROUND OF THE INVENTION

Many geographic locations have insufficient rainfall or dry spells that require turf and landscaping to be watered to maintain the proper health of the vegetation. Turf and landscaping are often watered utilizing an automatic irrigation system that includes a programmable controller that turns a plurality of valves ON and OFF to supply water through underground pipes connected to sprinklers. Golf courses, playing fields and other large areas typically require rotor-type sprinklers that eject a long stream of water via a single relatively large nozzle that oscillates through an adjustable arc. Smaller areas are often watered with fixed spray head sprinklers. Spray head sprinklers eject a fan-shaped pattern of water at a relatively high rate and much of this water often flows off the vegetation and/or blows away and is wasted. Rotary stream sprinklers can be used to irrigate small to medium sized areas. Rotary stream sprinklers eject relatively small individual streams of water, use less water than spray head sprinklers, and can cover larger areas than spray head sprinklers. In some cases drip nozzles are employed in residential and commercial irrigation systems for watering trees and shrubs, for example.

Rotary stream sprinklers sometimes incorporate a turbine and gear train reduction for slowly rotating the nozzle head or stream deflector. The turbine is typically located at the bottom of the sprinkler, below the gear box that holds the gear train reduction, and above the stator where one is employed. A rotary stream sprinkler can also use the water to directly power the stream deflector, in which case the flutes formed on the underside of the stream deflector that form and channel the streams of water are angled so that a rotational force on the stream deflector is generated. Where the water directly provides the rotary force to the stream deflector, a brake or damper is employed to slow the rate of rotation of the stream deflector. One type of a modern rotary stream sprinkler has a pop-up riser with an inverted frusto-conical distributor head. Water is channeled upwardly through a flow-adjustable aperture and impinges on the underside of the distributor head. The distributor head has spiral grooves that form the rotary streams.

FIG. 1 illustrates a stream deflector 2 of a conventional rotary stream sprinkler. The inner end of each of the flutes 4 terminates adjacent, and is aligned with, the rotational axis 6 of the stream deflector 2. Rotary stream sprinklers typically include a nozzle plate 8 (FIG. 2) with a suitably shaped orifice 10 that directs water onto the underside of the stream deflector 2 so that the streams only fall onto the desired shape of coverage, e.g. a ninety degree arc in the example shown. The nozzle plate can be a two part assembly that allows for an adjustable arc of coverage by rotating an upper plate in reference to a lower plate to increase or decrease the arc of coverage of the sprinkler as disclosed in U.S. patent application Ser. No. 12/577,002 of Richard M. Dunn et al.

In another conventional rotary stream sprinkler the nozzle plate 12 (FIG. 3) has a cylindrical configuration with multiple orifices 14, 16 and 18 that are either open, have varying degrees of restriction, or are plugged. In yet another conventional rotary stream sprinkler 20 (FIG. 4) the nozzle plate 22 has an arcuate orifice 24. Selected amounts of the orifice 24 can be blocked by inserting a plug 26 of suitable size so that the shape of coverage can be adjusted.

SUMMARY OF THE INVENTION

In accordance with the present invention a sprinkler includes a stream nozzle with a plurality of circumferentially spaced, radially extending stream forming ports. A non-rotating arc adjustment sleeve is mounted for axial movement relative to the stream nozzle to selectively block the stream forming ports to vary an arc of coverage of a plurality of streams of water ejected from the stream forming ports.

DETAILED DESCRIPTION

Figure 1:
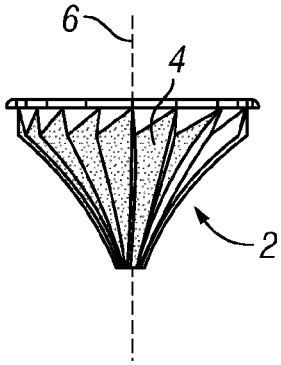
FIG. 1 (Prior Art)
FIG. 1 is a side elevation view of a stream deflector of a conventional rotary stream sprinkler.
Figure 2:
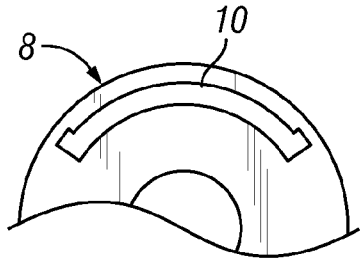
FIG. 2 (Prior Art)
FIG. 2 is a plan view of a nozzle plate of a conventional rotary stream sprinkler, the nozzle plate having an arcuate shaped orifice.
Figure 3:
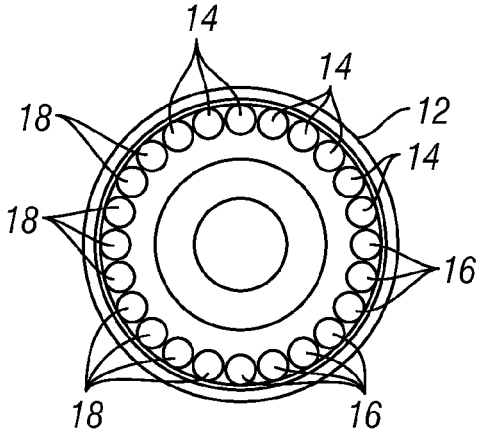
FIG. 3 (Prior Art)
FIG. 3 is a plan view a nozzle plate of another conventional rotary stream sprinkler, the nozzle plate having multiple orifices.

Unless otherwise indicated, except for the springs, the components of the sprinkler hereafter described are made of molded plastic parts. Referring to FIGS. 5, 6, 7 and 8, an embodiment of a pop-up rotary stream sprinkler 30 includes a tubular riser 32 having an upper outlet end and a lower inlet end. A cylindrical outer body 34 surrounds and telescopically receives the riser 32. A large steel coil spring 36 surrounds the riser 32 and is compressed within the outer body 34 between a lower riser flange 44 and an upper seal support 40. The coil spring 36 is held in place by a threaded cap 42 screwed over a male threaded segment at the upper end of the outer body 34. The coil spring 36 biases the riser 32 to a retracted position illustrated in FIG. 8 within the outer body 34. The riser 32 moves up to its extended position illustrated in FIGS. 5 and 7 when pressurized water is supplied through the inlet 38 of the outer body 34. A seal support 40 (FIG. 7) supports a riser seal 41 which prevents water from leaking out between the riser 32 and outer body 34.

Figure 4:
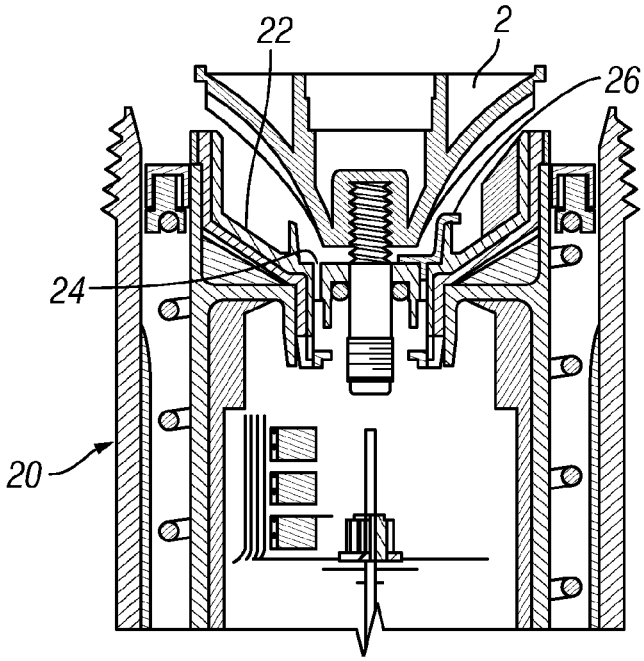
FIG. 4 (Prior Art)
FIG. 4 is a fragmentary vertical sectional view of another conventional rotary stream sprinkler having a nozzle plate with an arcuate orifice that is partially blocked by a plug to establish the shape of coverage of the sprinkler.

A turbine 46 (FIG. 7) is supported for high speed rotation within the riser 32. The turbine 46 drives an input stage of a reduction gear train 48. The gear train 48 is coupled to a final non-reversing geared segment or stage that drives a bull gear 49 with a drive shaft 47. The drive shaft 47 may include a clutch to protect the gears in the gear train 48 if the nozzle turret or nozzle head 90 is rotated by a vandal. See, for example, FIG. 4 of pending U.S. patent application Ser. No. 11/846,480 filed Aug. 28, 2007 of Ronald H. Anuskiewicz et al., assigned to Hunter Industries, Inc., the entire disclosure of which is hereby incorporated by reference. The arc adjusting and radius adjusting mechanisms of the rotary stream sprinkler 30 are all enclosed in the nozzle head 90, which, due to its overall cylindrical configuration, can be referred to as a "barrel head."

Figure 13:
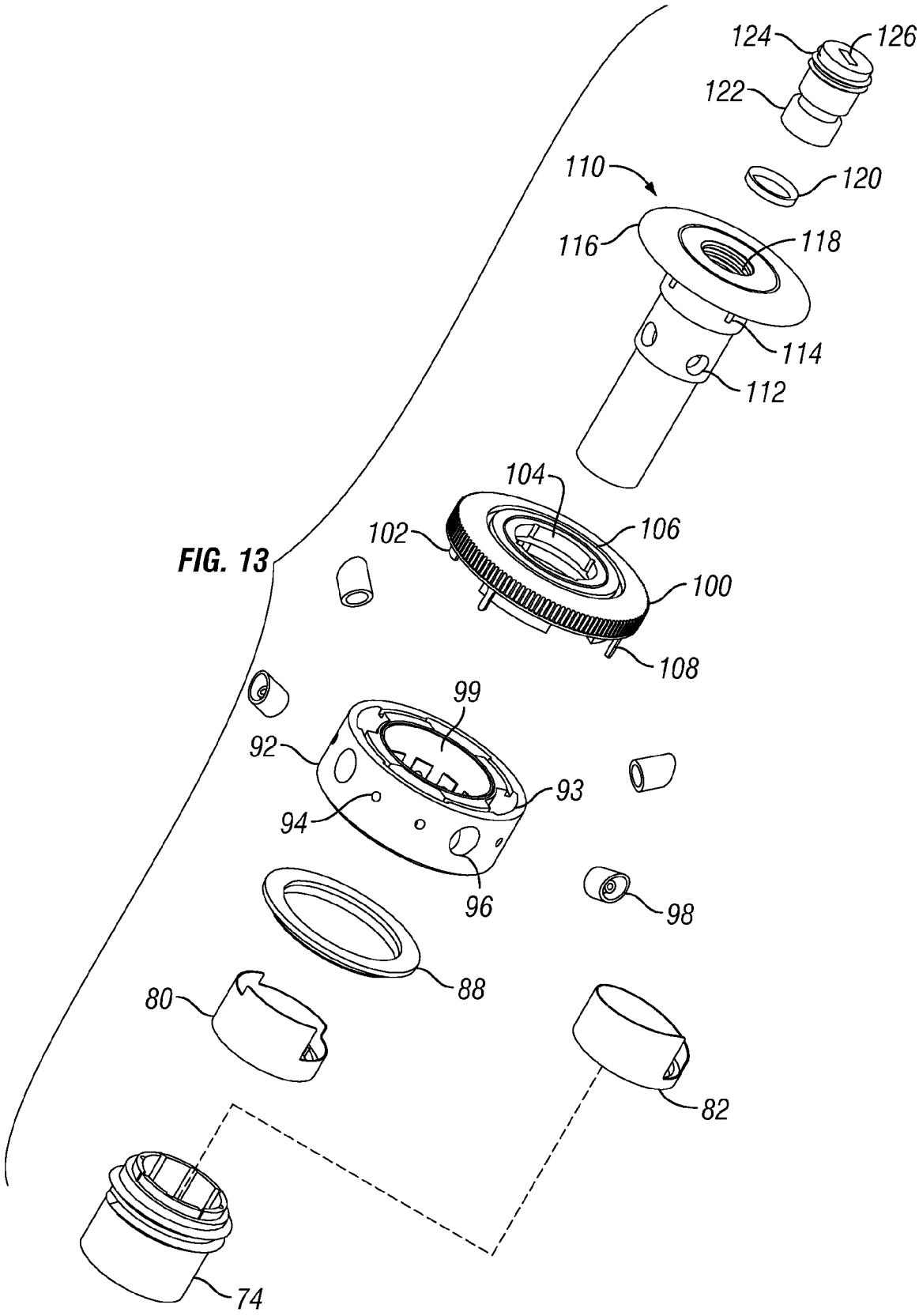
FIG. 13 is an enlarged portion of FIG. 11 illustrated further details of the rotary nozzle and flow control components.

The nozzle head 90 (FIG. 5) is rotatably mounted at the upper outlet end of the riser 12 for rotation about a vertical central axis (Z axis). The nozzle head 90 includes a ring-shaped rotating stream nozzle 92 that has twelve equally circumferentially spaced, radially extending, upwardly inclined stream forming ports 94 and 96 (FIG. 13). The stream forming ports 94 and 96 are formed as generally upwardly inclined bores and originate from an equal or common horizontal plane on the inner vertical cylindrical surface of the rotating stream nozzle 92. The nozzle head 90 is coupled to the bull gear 49 which is rotationally driven by the gear train 48. Water flowing through the inlet 38 passes through a filter screen 50 (FIG. 7) mounted in the lower inlet end of the riser 32 and then through a stator or speed regulator 52 (FIG. 8) that maintains the speed of rotation of the nozzle head 90 substantially constant regardless of variations in water pressure. The speed regulator 52 is constructed in the form of a spring biased throttling valve. Water leaving a plurality of directed ports (not illustrated) impinges against the fins of the turbine 46 to turn the gears in the gear train 48 before passing through the area between the housing drive assembly and the inner wall of the riser 12. The speed regulator 52 includes a throttling valve member 54 that reciprocates up and down to progressively open a port in the stator housing 56 as more flow is required. The throttling valve member 54 is biased to its retracted closed position by a small metal coil spring 58 whose lower end is captured by a spring retainer 59 coupled to the central shaft of the throttling valve member 54.

Figure 5:
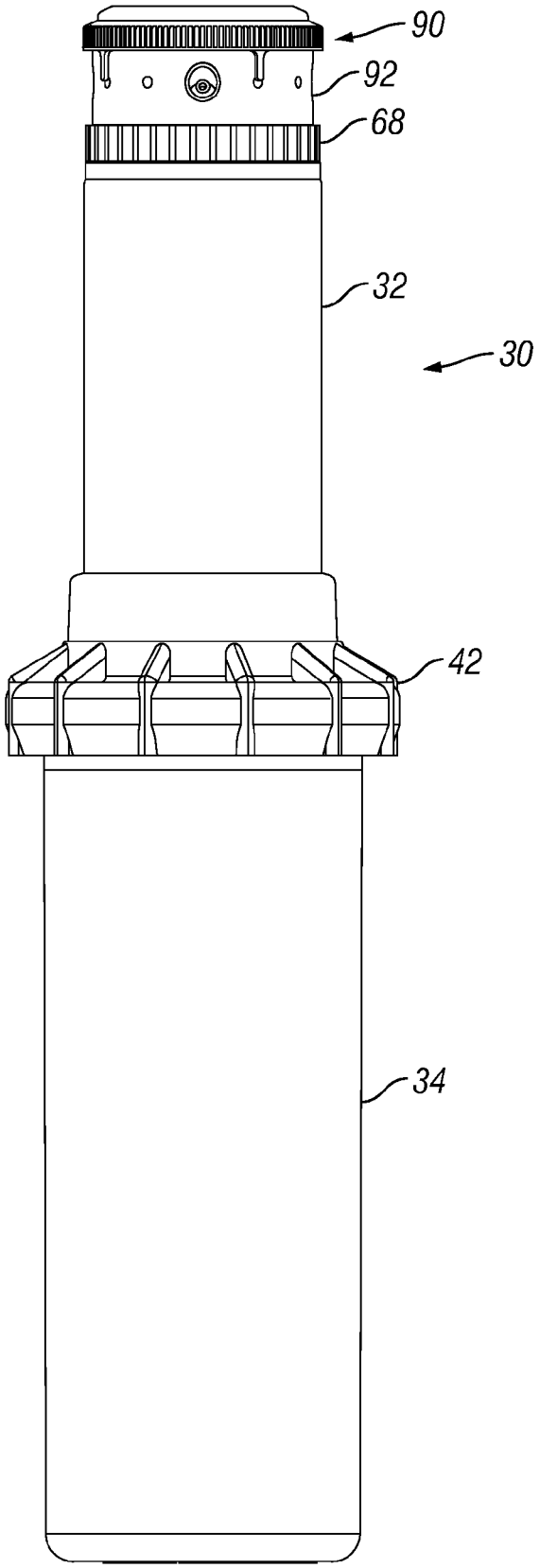
FIG. 5 is a side elevation view of a pop-up rotary stream sprinkler incorporating an embodiment of the present invention with its riser extended.
Figure 6:
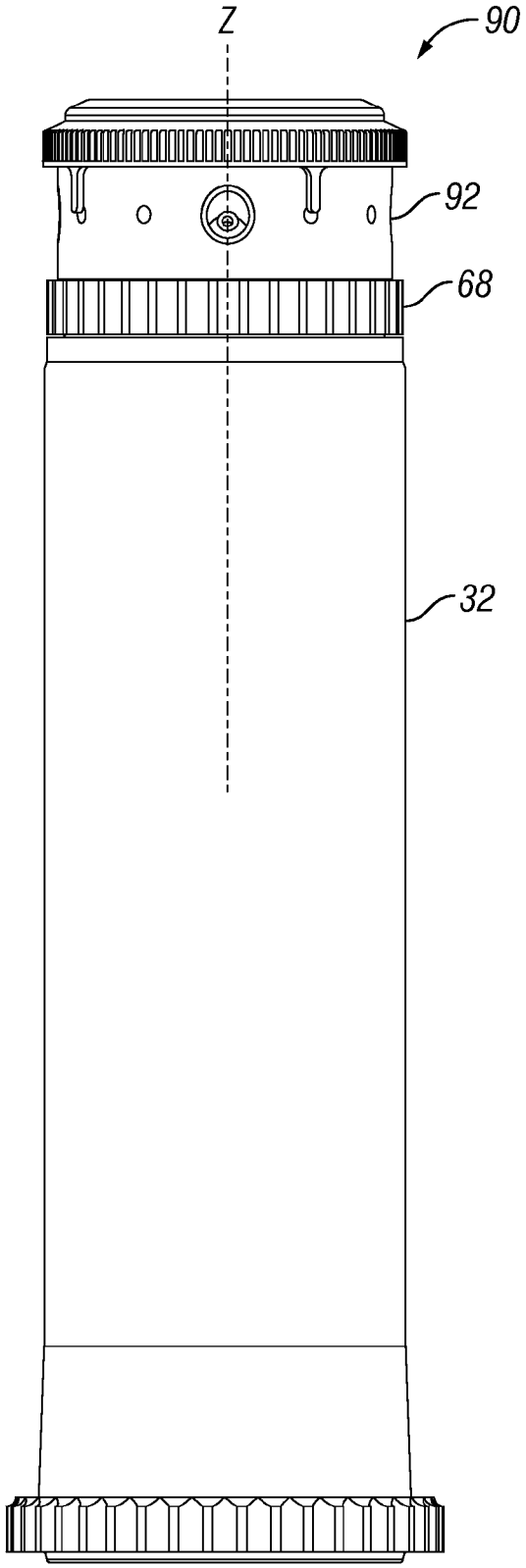
FIG. 6 is an enlarged view of the riser of the sprinkler of FIG. 5
Figure 7:
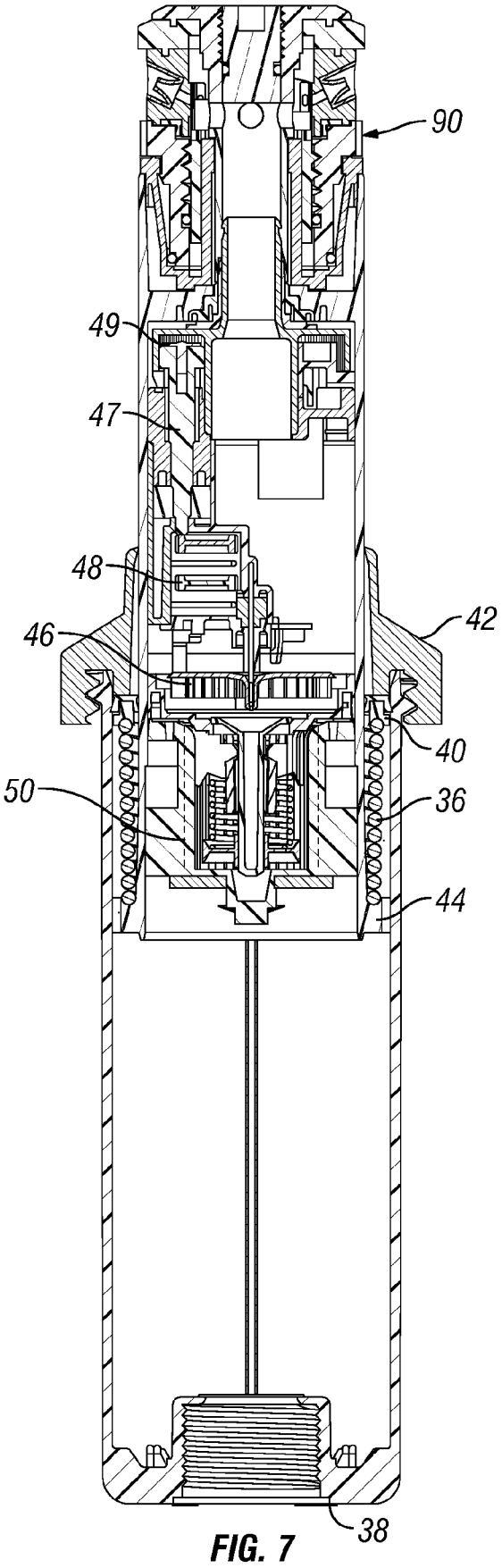
FIG. 7 is a vertical sectional view of the sprinkler of FIG. 5.
Figure 8:
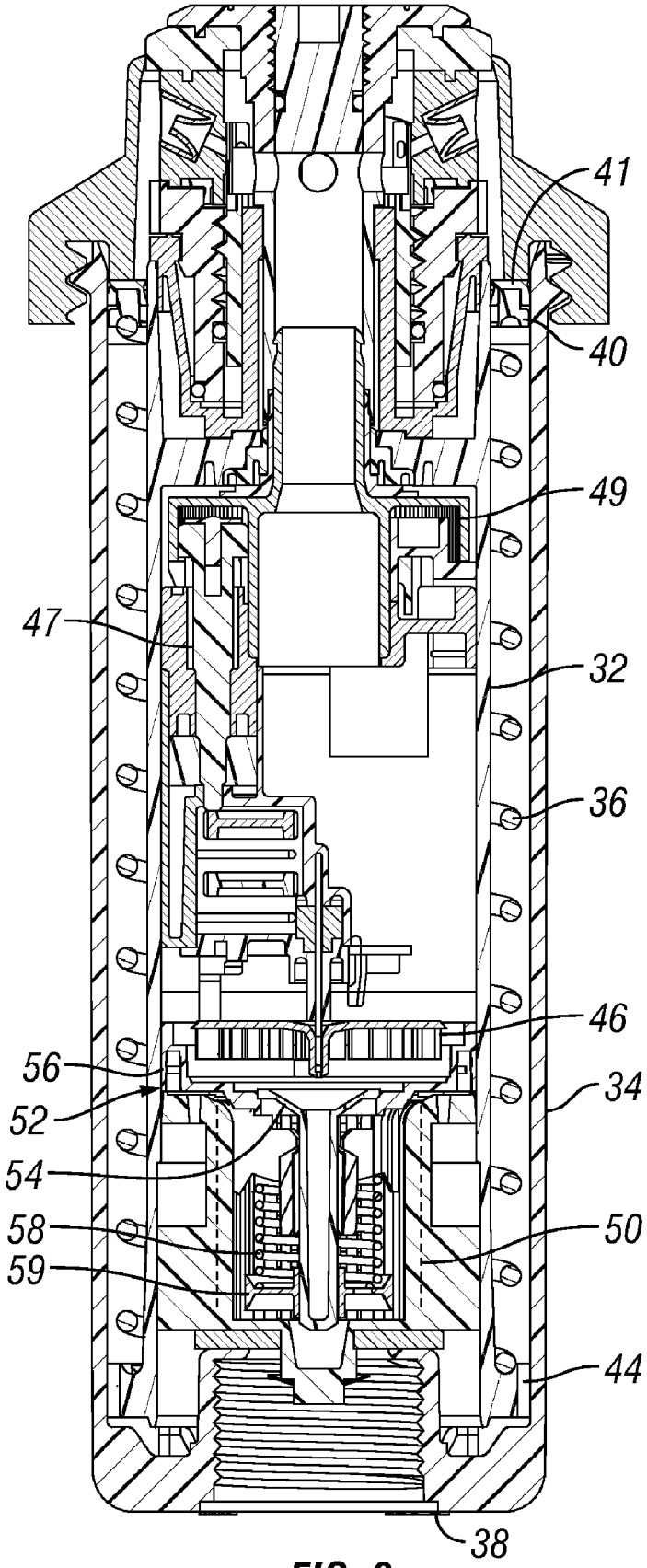
FIG. 8 is a view similar to FIG. 7 with the riser in its retracted position.
Figure 11:
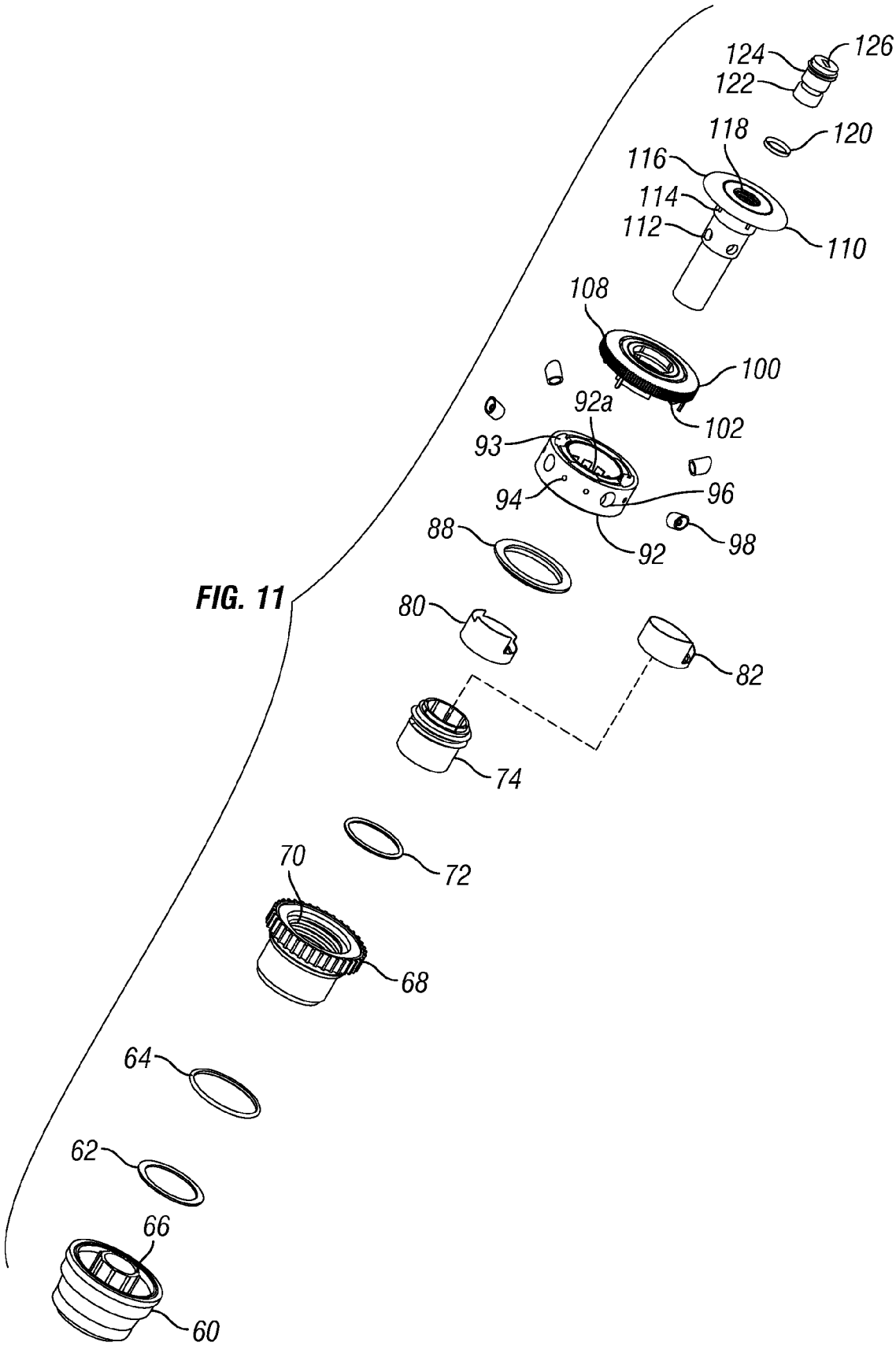
FIG. 11 is a further enlarged portion of FIG. 10 illustrating further details of the nozzle, adjustable arc components, and adjustable flow components.
Figure 12:
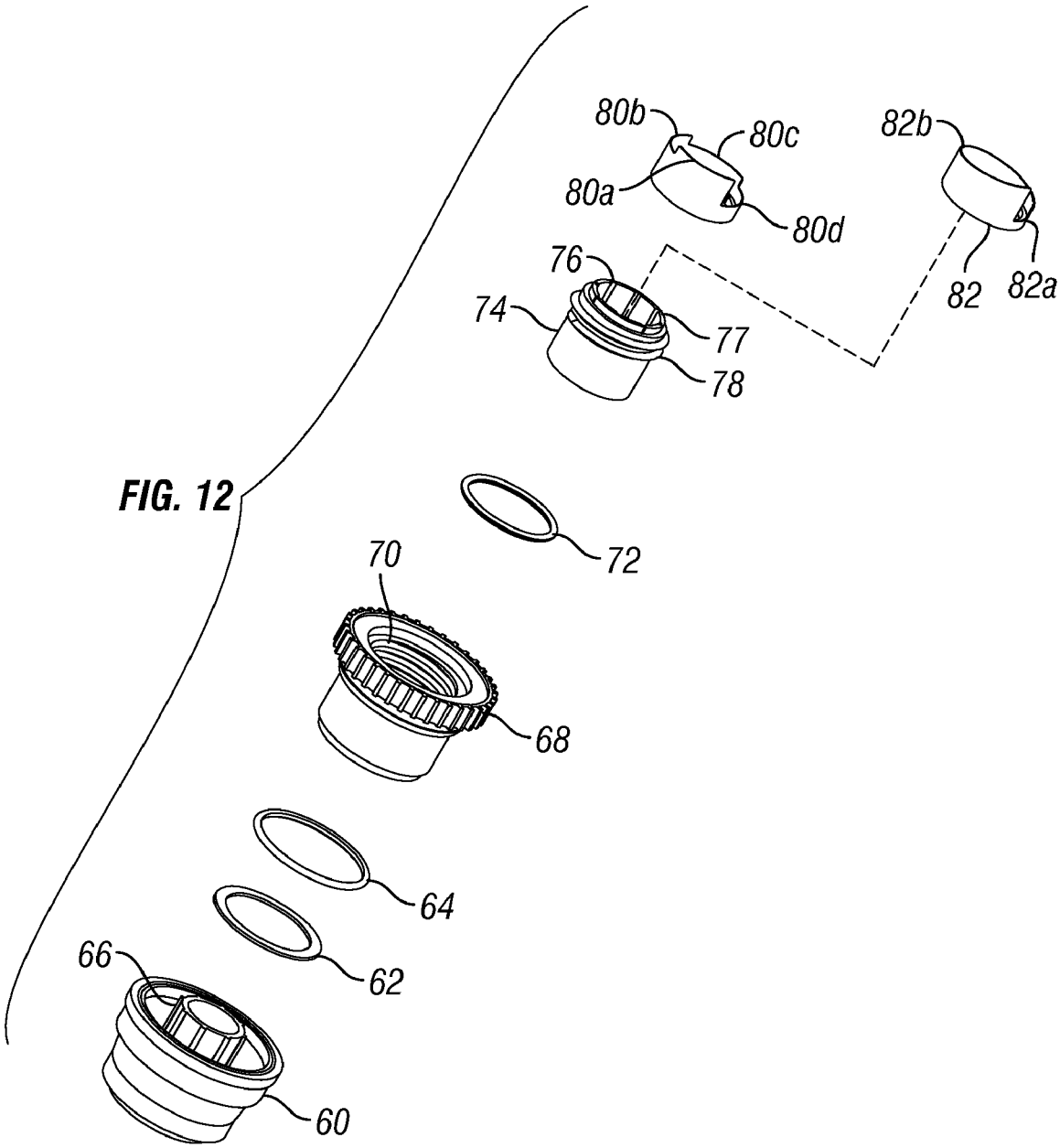
FIG. 12 is an enlarged portion of FIG. 11 illustrating further details of the arc adjustment components.

The nozzle head 90 includes rotating components illustrated in FIG. 12 that are driven by the gear train 48 to distribute water in a rotary fashion working in conjunction with normally stationary components that are held non rotationally by the body to regulate the arc of coverage. A stationary hub 60 is securely fastened to the upper end of the riser 32, immediately below the nozzle head 90. An adjusting member in the form of an adjusting ring 68 loosely fits inside of the stationary hub 60 and can be manually rotated to change the arc of coverage of the sprinkler 30. As best seen in FIG. 5, the adjusting ring has a knurled outer cylindrical surface roughly the same diameter as the outer diameter of the riser 32 that can be manually gripped and rotated by a user to adjust an arc of coverage of the sprinkler 30. A Teflon® plastic washer 62 and an O-ring 64 fit between the adjusting ring 68 and the stationary hub 60 to allow the adjusting gearing 68 to move smoothly and not leak water. A pattern cup base 74 fits over the ribbed center hub 66 of the stationary hub 60. The adjusting ring 68 can be rotated to screw the male threads 78 on the upper end of the pattern cup base 74 into the complementary female threads 70 formed in the upper end of the adjusting ring 68. An O-ring 72 prevents water from leaking between the pattern cup base 74 and the adjusting ring 68. The ribbed center hub 66 is slip fit with the inner bore 77 and recesses 76 to keep the pattern cup base 74 from rotating. When the adjusting ring 68 is manually rotated by the user, the pattern cup base 74 moves axially up or down without rotating. An arc adjustment sleeve in the form of a generally cylindrical pattern helix 80 (FIG. 13) is securely attached to the top of the pattern cup base 74 so it moves axially up or down with the pattern cup base 74 without rotating. Thus the nozzle head 90 includes a normally stationary arc adjustment sleeve in the form of the cylindrical pattern helix 80 that is situated in a central bore 92*a* (FIG. 11) of the ring-shaped rotating stream nozzle 92. As will be more fully apparent from the description hereafter, the arc adjustment sleeve can be axially raised and lowered by a user so that a stepped or sloped circular upper edge thereof will selectively obstruct predetermined ones of the stream forming ports 94 and 96 to thereby vary an arc of coverage of a plurality of streams of water ejected from the stream forming ports 94 and 96.

Figure 9:
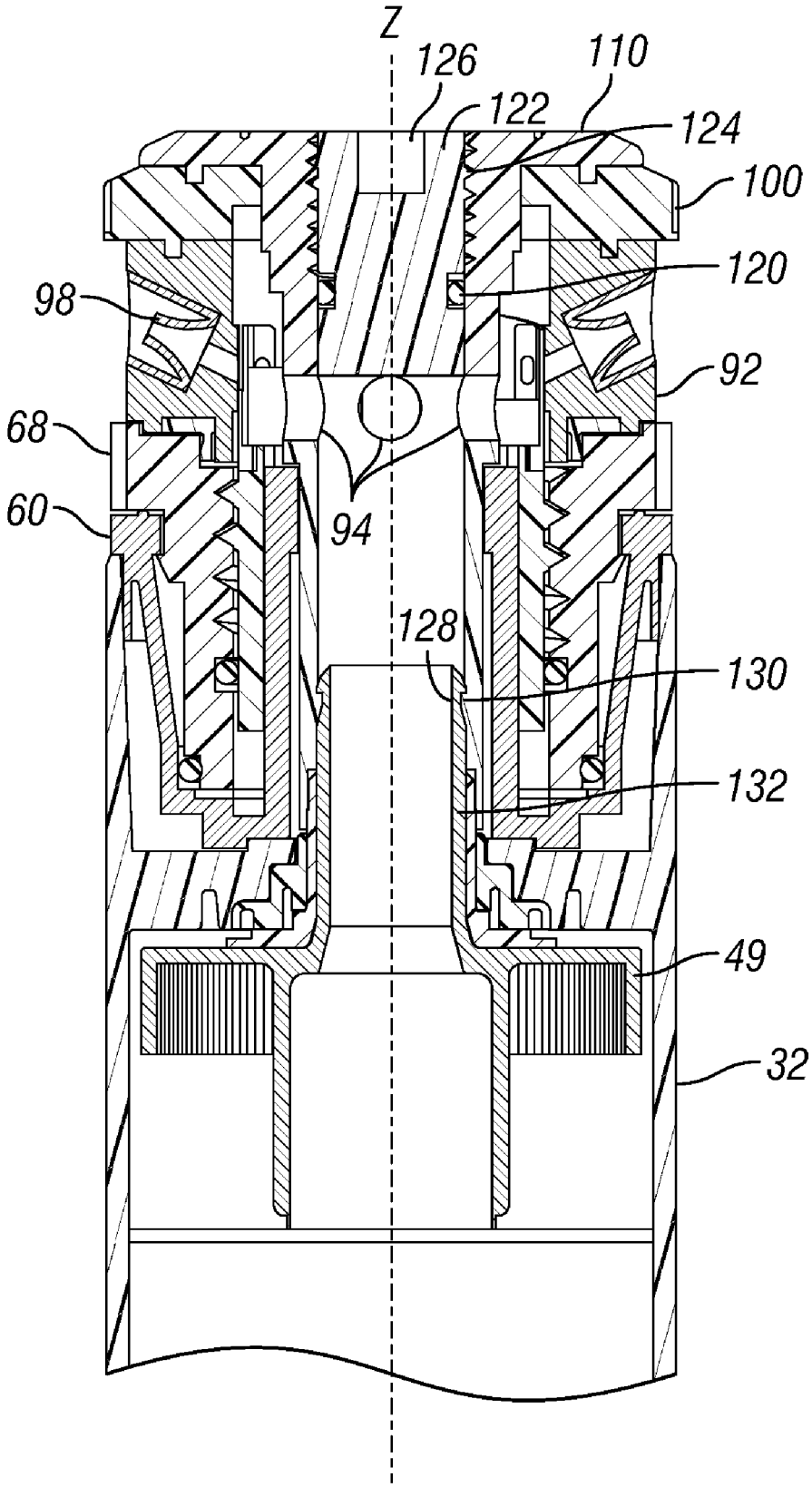
FIG. 9 is an enlarged portion of FIG. 7 illustrating details of the upper end of the riser including the bull gear, nozzle, adjustable arc components and adjustable flow components.
Figure 10:
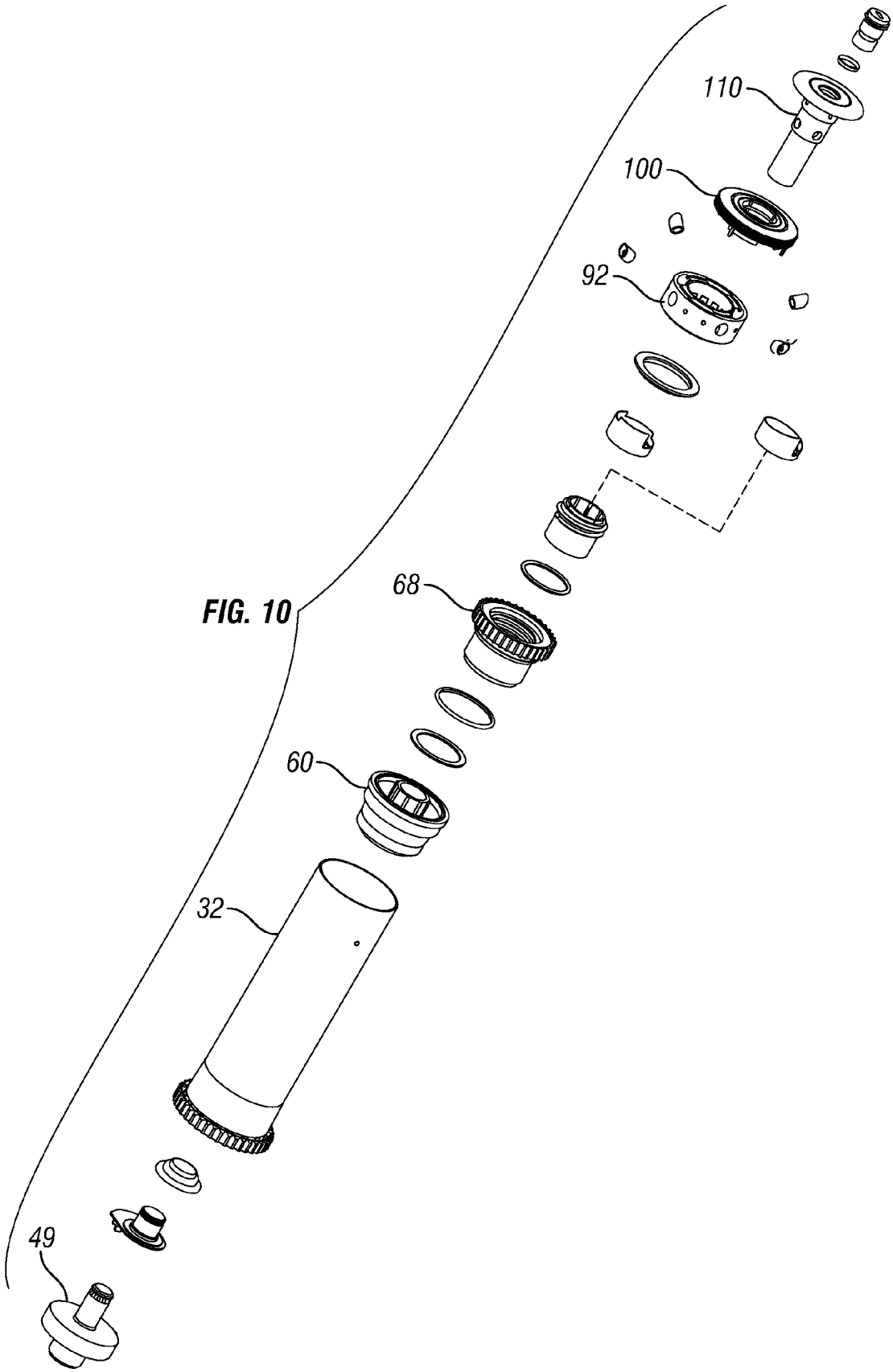
FIG. 10 is an exploded view of the components of the riser of the rotary stream sprinkler illustrated in FIG. 9.

FIGS. 9 and 13 illustrate further details of the rotating nozzle head 90. As previously mentioned, the bull gear 49 (FIG. 9) is rotationally driven by the gear train 48. This supplies rotational motion to the nozzle head 90. The rotating stream nozzle 92 is supported on the seal 88 (FIG. 13). The seal 88 is made of a low friction elastomeric material that provides a water tight seal between the rotating stream nozzle 92 and the adjusting ring 68 while allowing the rotating stream nozzle 92 to rotate during normal operation relative to the adjusting ring 68. The rotating stream nozzle 92 has twelve equally spaced ports. The ports 96 receive nozzle inserts 98 to irrigate a specific radius of the irrigated area. This may be the furthest radius form the sprinkler 30. The ports 94 directly emit water to irrigate the landscape located at a different radius from the sprinkler 30, such as the closest and midrange radius coverage.

A nozzle cap 100 (FIG. 13) is installed directly above rotating stream nozzle 92 and includes four downwardly extending stream diffuser pins 108. The length of each of these pins is pre-selected to restrict the water coming out of the ports 94. This will reduce flow and radius of the water streams of water ejected from the port 94. The nozzle cap 100 is rotationally coupled to the rotating stream nozzle 92 to provide rotational movement by inserting the drive tabs 102 into the drive pockets 93 of the of the rotating stream nozzle 92. A bull gear insert 110 is the final link that couples the rotational movement of the bull gear 49 to the rotating stream nozzle 92. The bull gear insert 110 includes a plurality of drive dogs 114 that extend downwardly from a bull bear flange 116. The drive dogs 114 mate with corresponding pockets 106 in the nozzle cap 100 to transmit rotational movement. The bull gear insert 110 extends through the bore 104 of the nozzle cap 100 and is rigidly attached to the bull gear 49 to provide rotational movement and sandwich all of the rotary nozzle components together between the seal 88 and the bull gear flange 116. In the illustrated embodiment, the bull gear 49 has a groove 128 that accepts the internal ridge 130 (FIG. 9) of the bull gear insert 110 to create a snap fit assembly. Very small gear teeth (not illustrated) formed on the outer cylindrical surface of the bull gear stem 132 mesh with mating internal teeth (not illustrated) formed on the lower end of the bull gear insert 110 to provide a rotational drive coupling.

The flow control assembly of the sprinkler 30 is used to increase or decrease the amount of water flowing to the rotating stream nozzle and increase or decrease the radius of the irrigated area. The bull gear insert 110 (FIGS. 9 and 13) includes four ports 112 where the water flows under pressure from the inside of the bull gear 49 to the rotating stream nozzle 92. Threads 124 on a cylindrical flow stop 122 are screwed into internal threads 118 formed on an interior wall of a bore through the bull gear insert 110. O-ring 120 prevents water leaks between the two components. A slot 126 is formed in the top of the flow stop 122 so a tool can be inserted into the slot 126 to screw the flow stop 122 in or out of the bull gear insert 110. As seen in FIG. 9, the slow stop 122 is positioned to allow a maximum flow of water through ports 112. As the user screws the flow stop 122 further inwards, the flow stop 122 will increasingly restrict the amount of water that flows though the ports 12, and reducing the radius of throw of the water exiting the rotating stream nozzle 92. The flow stop 122 can be screwed down far enough to completely stop the flow of water which is sometimes beneficial for maintenance.

Figure 14:
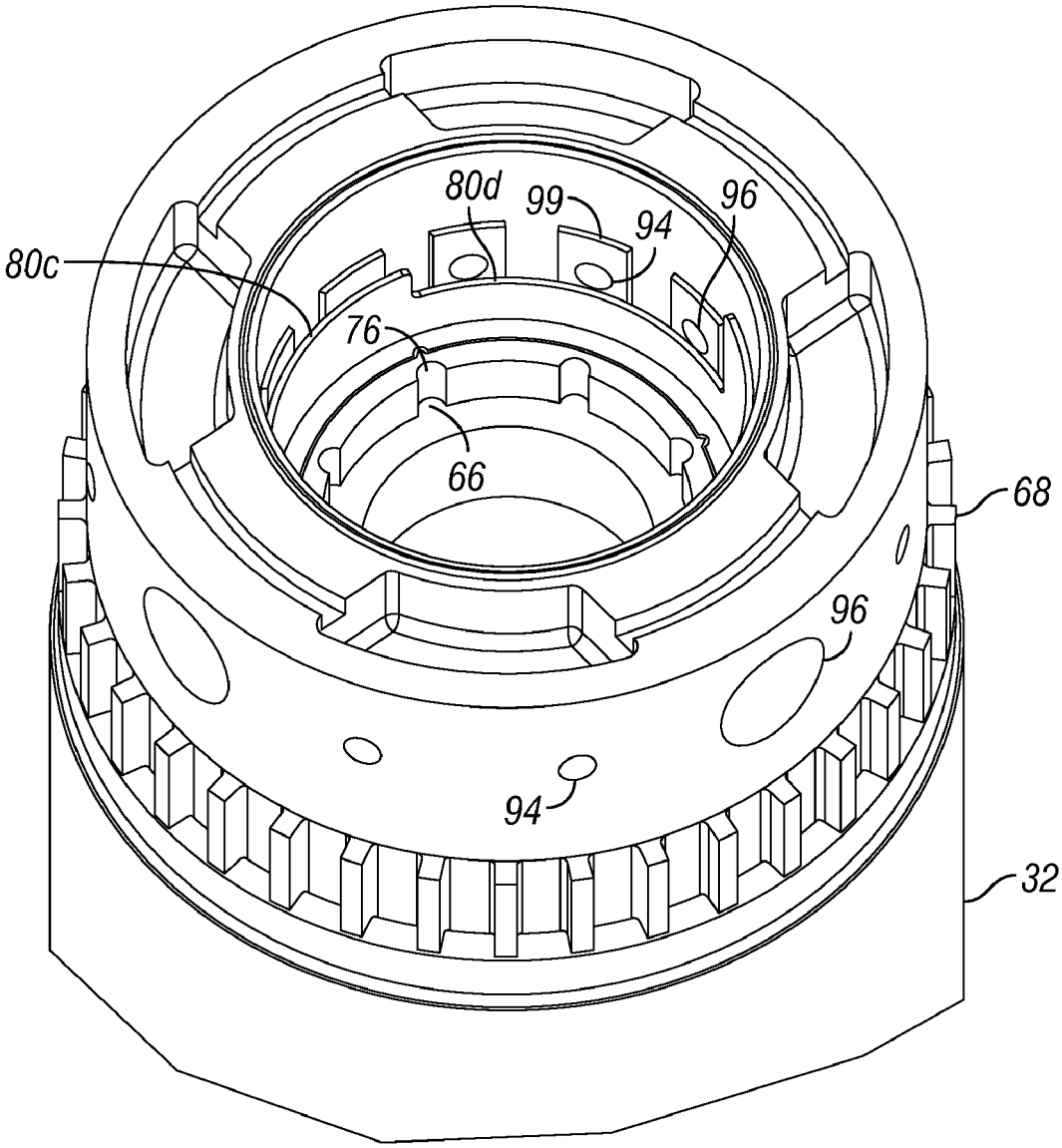
FIG. 14 is an enlarged assembled view of the inside of the nozzle of the sprinkler of FIG. 5 illustrating its stepped pattern helix set to ninety degrees.
Figure 15:
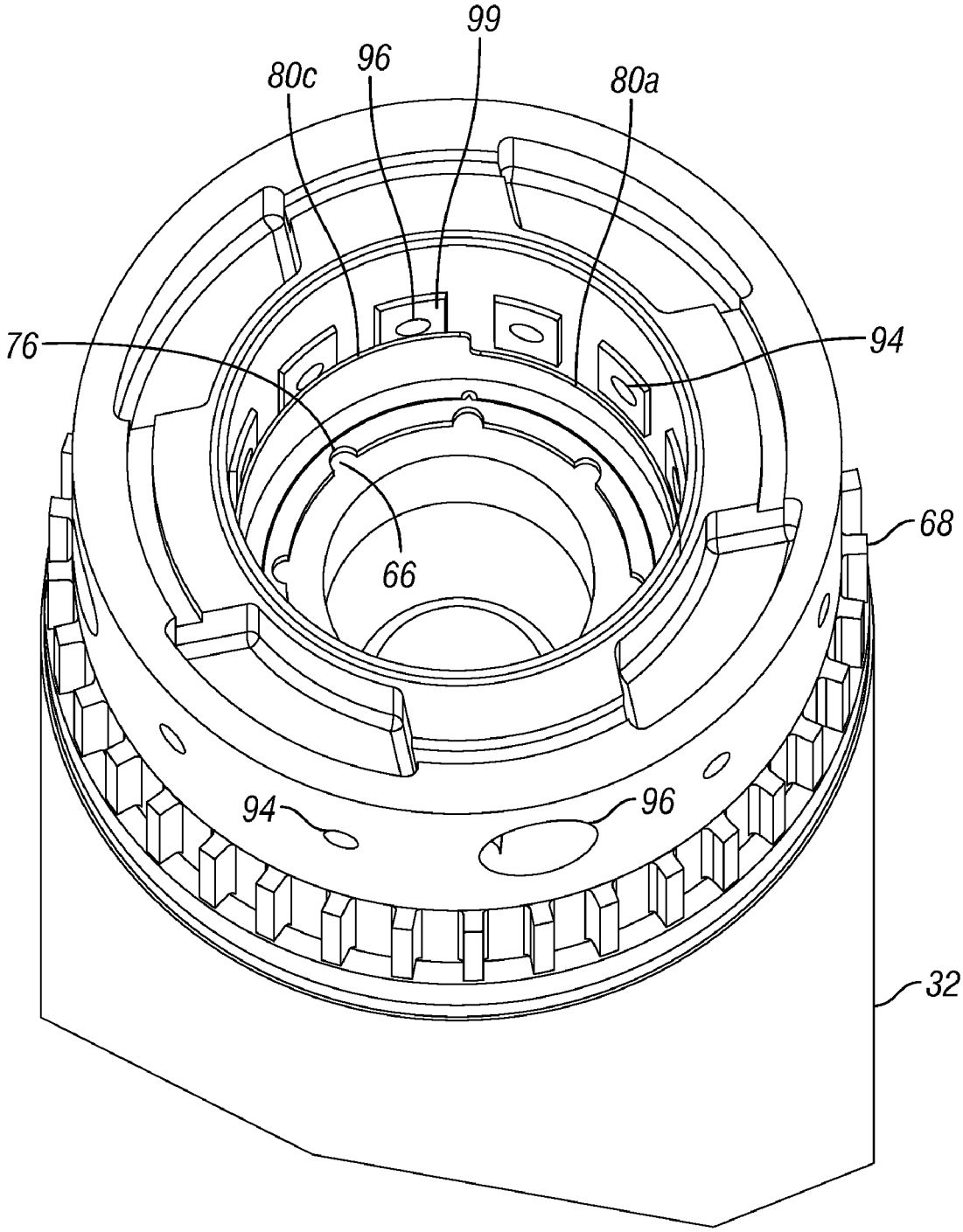
FIG. 15 is a view similar to FIG. 14 with the stepped pattern helix set to one hundred and eighty degrees.
Figure 16:
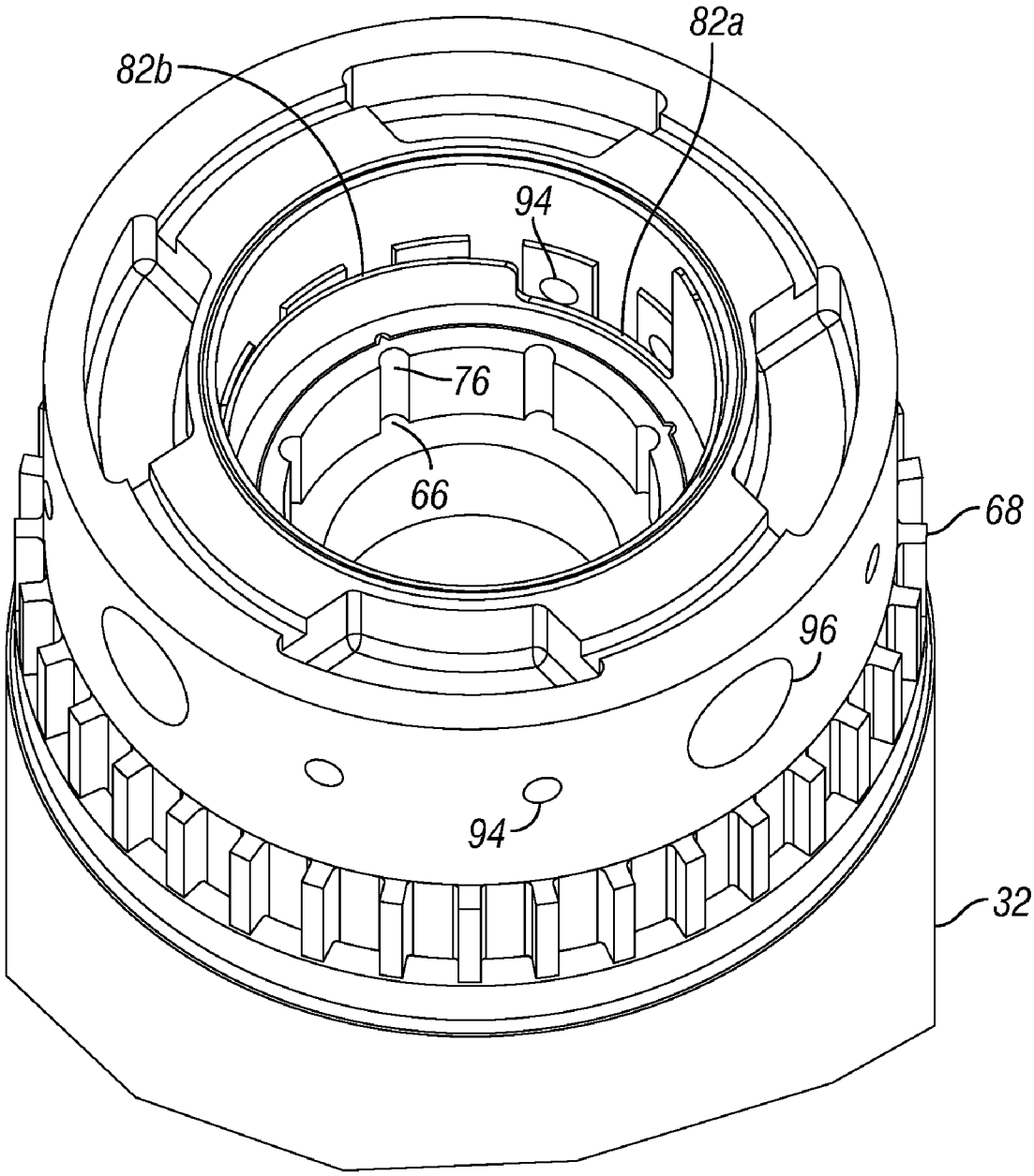
FIG. 16 is view similar to FIG. 14 with a sloped pattern helix set to a minimum arc.
Figure 17:
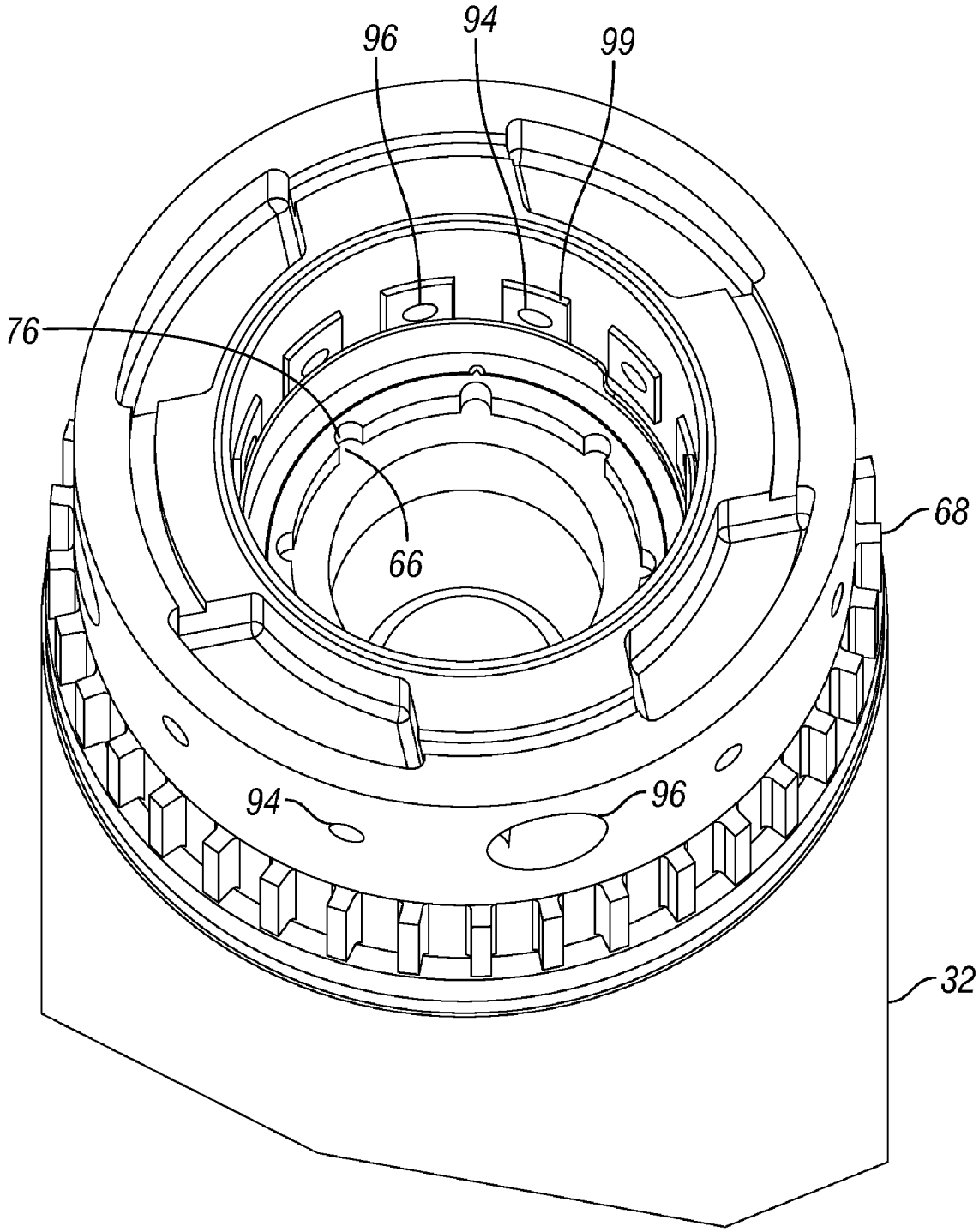
FIG. 17 is a view similar to FIG. 14 with a sloped pattern helix set to approximately one hundred and forty degrees.

As best seen in FIG. 12, the step pattern helix 80 has four upper edge surfaces 80*a* though 80*d* which terminate at different elevations. When the pattern cup base 74 is fully raised, surface 80*d* is positioned immediately below the ports 94 and 96 of rotating stream nozzle 92. Surfaces 80*a*, 80*b*, and 80*c* block water from entering the ports 94 and 96 preventing irrigation for that arc area. This configuration is illustrated in FIG. 14. As the rotating stream nozzle 92 turns during normal operation, the ports immediately above surface 80*d* are exposed to the pressurized water and an arc area of ninety degrees is irrigated. When the pattern cup base 74 is lowered slightly (FIG. 15), surfaces 80*d* and 80*c* are positioned immediately below the ports 94 and 96 of the rotating stream nozzle 92. Surfaces 80*a*, and 80*b*, still block water from entering the ports 94 and 96 preventing irrigation for that arc area. As the rotating stream nozzle 92 turns during normal operation, the ports immediately above surfaces 80*c* and 80*d* are exposed to the pressurized water and an arc area of one hundred and eighty degrees is irrigated. This is repeated to irrigate an arc area of two hundred and seventy degrees. When the pattern helix 80 is in its fully lowered position, all ports 94 and 96 are exposed and the rotating stream nozzle 92 rotates and irrigates a full three hundred and sixty degree circular pattern of coverage. Alternatively, step pattern helix 80 could be replaced with a generally cylindrical sloped pattern helix 82 (FIG. 12). The sloped pattern helix 82 has an exposed base 82*a* that allows for irrigation of ninety degrees of the landscape and an inclined upper edge surface 82*b* that begins and ends at different elevations. When the pattern cup base 74 is fully raised (FIG. 16), surface 82*a* exposes approximately ninety degrees of area of the inner surface 99 of the rotating stream nozzle 92. The remaining surface 82*b* blocks water to the remaining ports 94 and 96 of rotating stream nozzle 92. As the rotating stream nozzle 92 turns during normal operation, the ports not blocked by surface 82*b* are exposed to the pressurized water and an arc area of 90 degrees is irrigated. When the pattern cup base 74 is lowered slightly (FIG. 17), the surface 82*b* is lowered and exposes a larger arc of exposed ports 94 and 96. In this figure, approximately one hundred and forty degrees of the inner surface of the rotating stream nozzle 92 is exposed, with the remaining area blocked. As the rotating stream nozzle 92 turns during normal operation, the ports not blocked by surface 82*b* are exposed to the pressurized water and an arc area of 140 degrees is irrigated. This is repeated to infinitely adjust the arc of coverage between ninety and three hundred and sixty degrees. When the sloped pattern helix 82 is in its fully lowered position, all ports are exposed and the sprinkler rotates and irrigates a full three hundred and sixty degree circular pattern of coverage. It will be understood that in all of the configurations of the sprinkler 30 multiple streams of water are simultaneously ejected from the rotating stream nozzle 92.

To recapitulate, in accordance with the present invention an adjustable arc and adjustable radius sprinkler includes a riser having an inlet end and an outlet end and a nozzle rotatably supported at the outlet end of the riser. The nozzle has a plurality of circumferentially spaced, radially extending stream forming ports. A reduction gear drive is coupled for rotating the nozzle. A non-rotating arc adjusting sleeve has an upper surface with varying heights. The arc adjusting sleeve selectively blocks the ports of the nozzle to determine the arc of coverage. A manually adjusting ring is mounted in relationship with the arc adjusting sleeve. As the manually adjusting ring is rotated, it raises or lowers the arc adjusting sleeve. When the adjusting ring is rotated in a first direction, the sleeve is lowered and water is allowed to enter the ports on the rotating nozzle through a greater degree of rotation. When the adjusting ring is rotated in an opposite direction, the sleeve is raised and water is allowed to enter the ports on the rotating nozzle through a lesser degree of rotation. The greater or lesser degrees of rotation that the water is allowed to enter the ports results in an increase or decrease of the arc of an arc shaped water distribution pattern. A flow stop in the top of the nozzle can be manually screwed in and out to allow more or less water to enter into the nozzle area. This increases or decreases the radius of the wetted area of the arc shaped water distribution pattern. A known problem with prior art adjustable orifice sprinklers is that they typically have narrow arcuate openings that can collect debris which creates gaps in the irrigated area, or stops irrigation all together. The present invention eliminates the narrow orifices associated with prior art adjustable arc rotary stream sprinklers.

Figure 18:
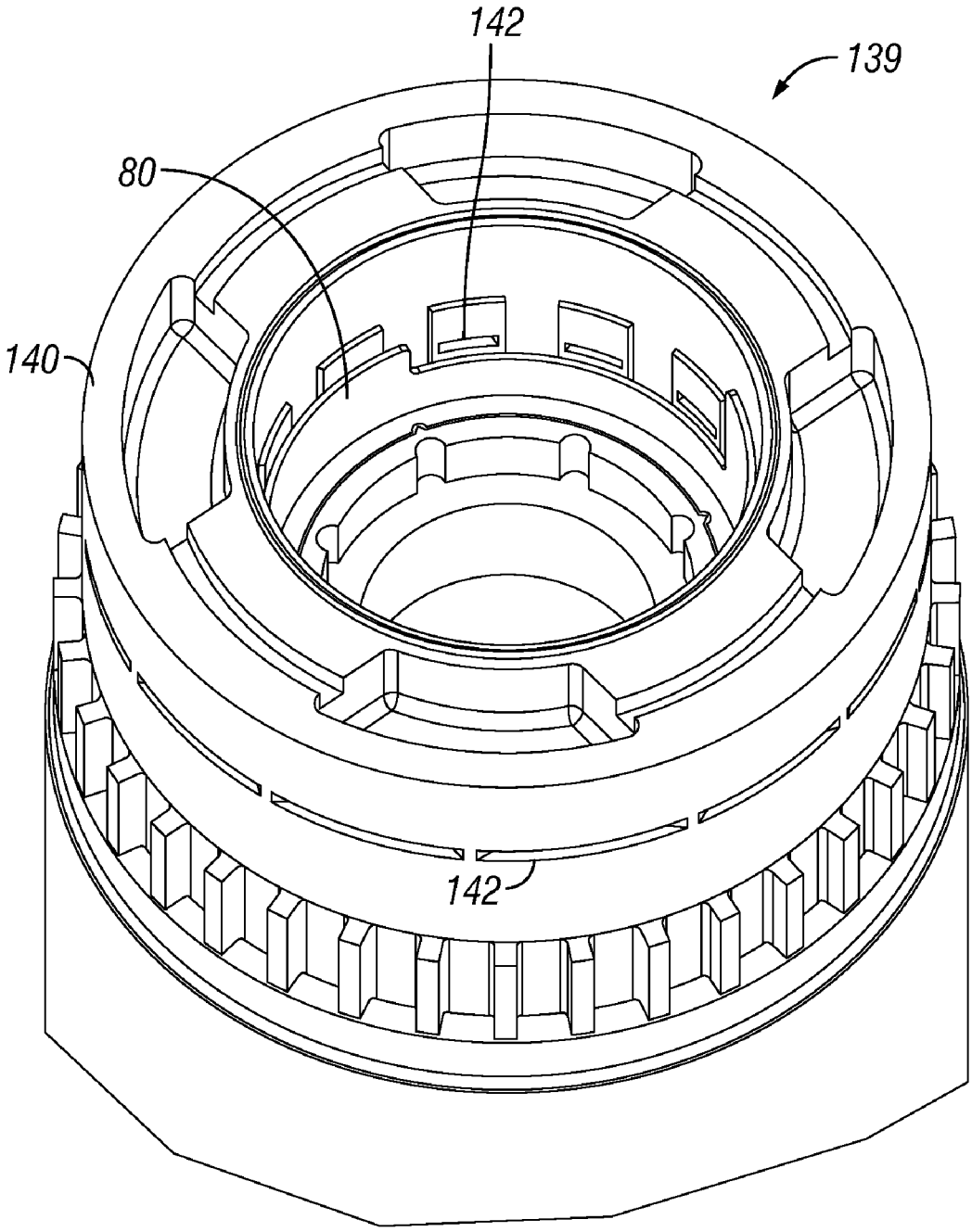
FIG. 18 is a view similar to FIG. 14 illustrating a non-rotating alternate embodiment.

FIG. 18 illustrates a non-rotating alternate embodiment of a nozzle head 139 that provides a constant fan—shaped spray pattern of water with an adjustable arc of coverage, similar to that provided by a spray—type sprinkler nozzle. The nozzle head 139 share some common structure with the nozzle head 90 and is coupled to the riser 32. The riser 32 does not house any drive components since the nozzle head 139 does not rotate. A plurality of horizontally extending slots 142 are formed in a non rotating ring 140. The slots 142 are equally circumferentially spaced. When uncovered each of the slots 142 provides a portion of the constant fan-shaped spray of water covering a specific arc area. In the configuration illustrated the nozzle head 139 provides an arc of coverage of ninety degrees. As the stepped helix 80 is lowered, additional slots 142 are sequentially exposed to the pressurized water inside the nozzle head 139 and the overall arc of coverage is increased.

Figure 19:
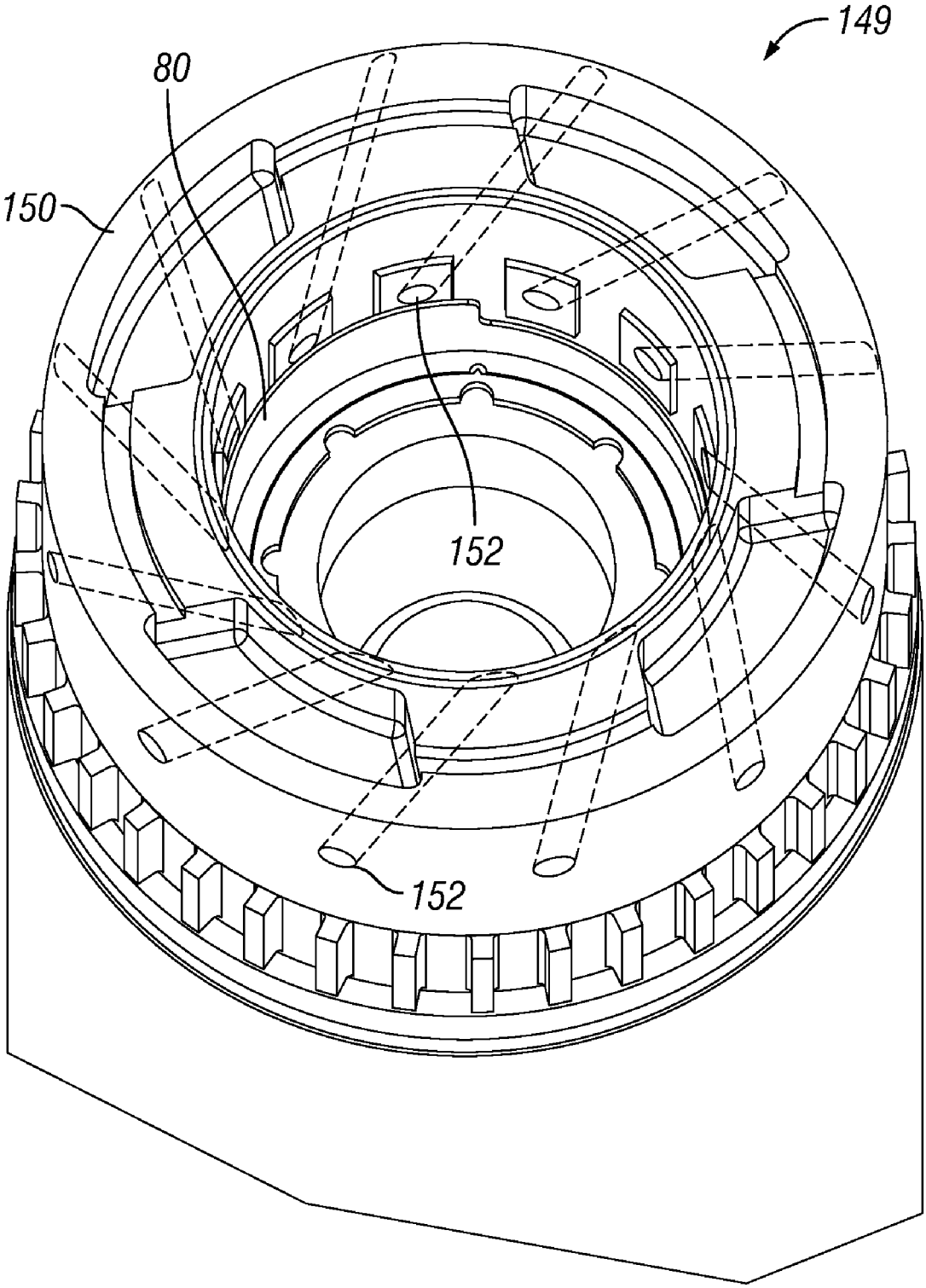
FIG. 19 is a view similar to FIG. 19 illustrating a rotating embodiment that does not include a gear drive.

FIG. 19 illustrates a rotating embodiment of a nozzle head 149 that does not include a gear drive. The nozzle head 149 includes a nozzle ring 150 with a plurality of tangentially and radially directed ports or nozzles 152 so that the streams of water ejected from the same rotationally drive the nozzle head 149 about its vertical axis. The nozzles 152 are preferably tubular in shape and are equally circumferentially spaced about the nozzle ring 150 as illustrated in phantom lines in FIG. 19. The riser 32 does not house any drive components. Instead, nozzle head 149 is coupled to the riser 32 with a speed reducing system (not illustrated) to appropriately control the speed of rotation of the rotating stream nozzle 92. Various speed reducing mechanisms can be implemented to control the rotational speed of the head such as a friction brake or a viscous damper, examples of which are illustrated in some of the patents incorporated by reference above. As the water is emitted with pressure and velocity through the nozzles 152, the streams irrigate the area directly in their path, and the reactionary force of the water streams also rotationally drives the nozzle ring 152. The arc of coverage of the nozzle head 149 can be varied by lowering and raising the stepped helix 80.

Figure 20:
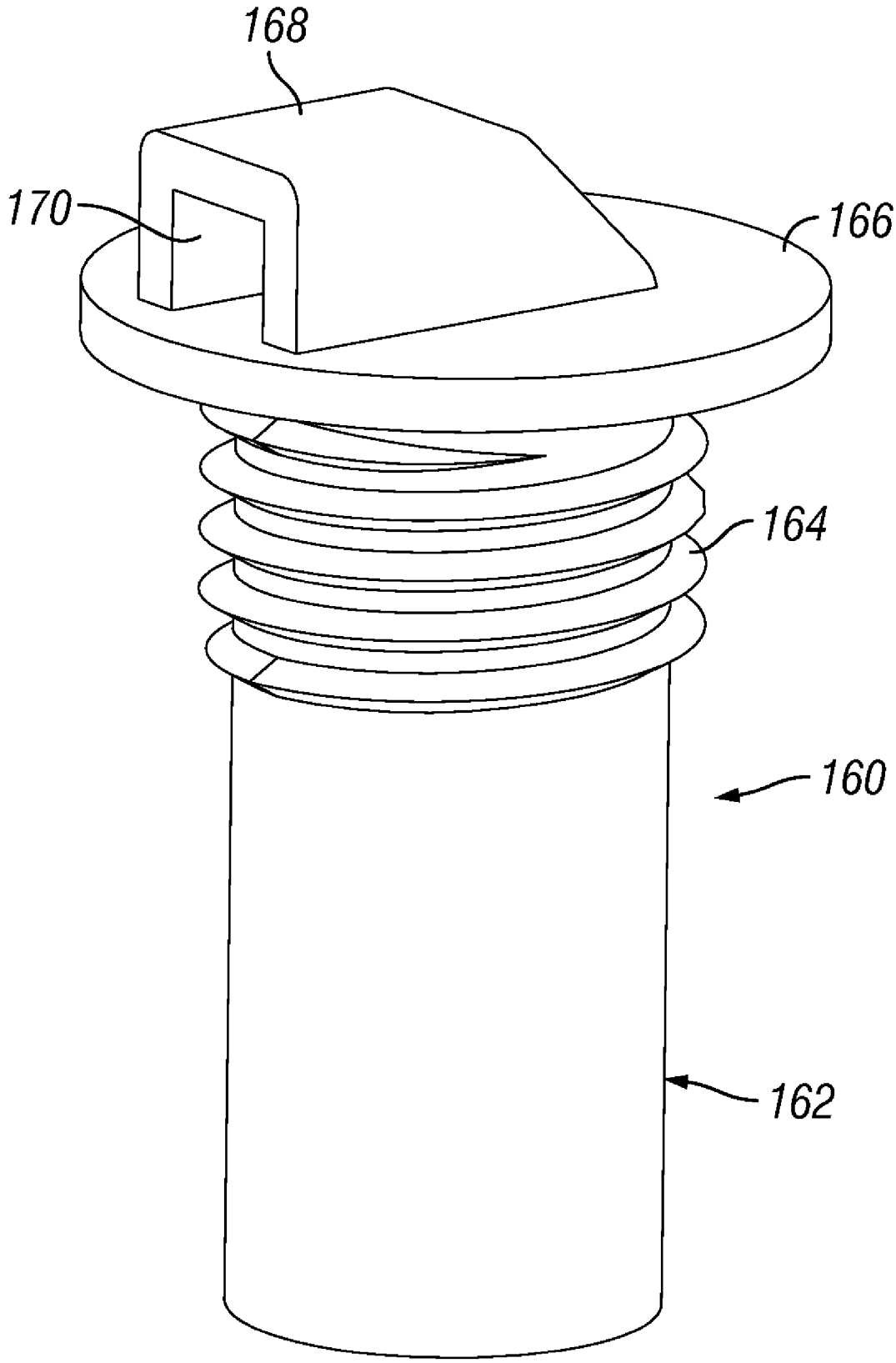
FIG. 20 is an enlarged isometric view of a flush plug suitable for use with the sprinkler illustrated in FIGS. 5-17.
Figure 21:
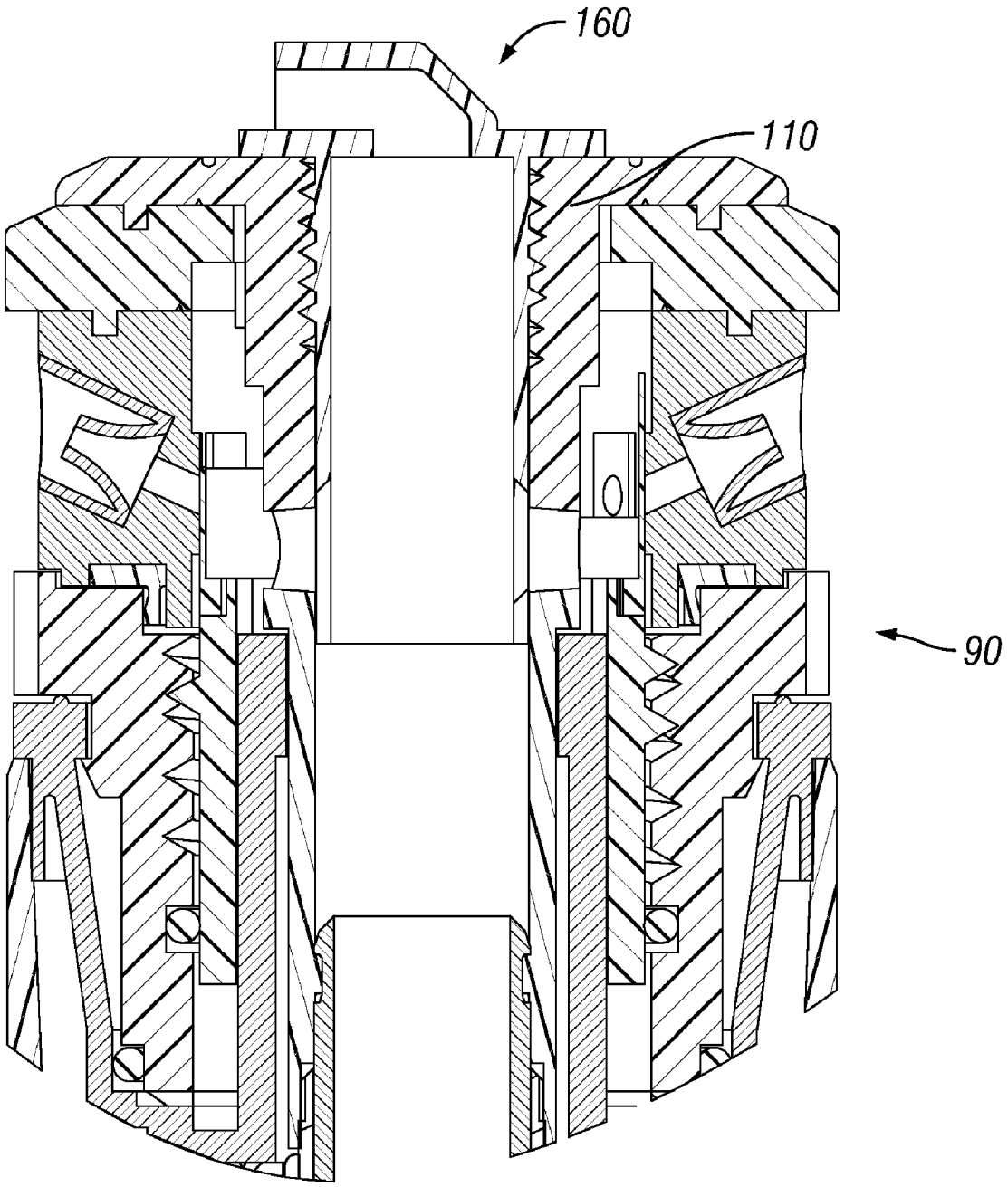
FIG. 21 is a vertical sectional view through the barrel head of the sprinkler of FIGS. 5-17 illustrating the flush plug of FIG. 20 in its operative position.

When the sprinkler 30 is first installed, particularly in a brand new irrigation system, there may be dirt and other debris in the subterranean PCV pipe (not illustrated) that is connected to the solenoid actuated valve (not illustrated) and supplies water to the sprinkler 30. A cylindrical flush plug 160 (FIG. 20) may be temporarily installed in the barrel head 90 by removing the cylindrical flow stop 122. This will allow the irrigation system to be flushed to clean out dirt and debris without water entering the stream forming ports 94 and 96 (FIG. 13) and these ports becoming clogged or otherwise obstructed. The flush plug 160 has a long cylindrical sleeve 162 dimensioned to fit within the bull gear insert 110 after the flow stop 122 has been unscrewed from the same as illustrated in FIG. 21. The sleeve 162 has an upper male threaded segment 164 (FIG. 20) that can be screwed into internal threads 118 of the bull gear insert 110. The flush plug 160 has a cap 166 formed at its upper end with a laterally opening manifold 168 defining a water flow path that extends from the interior of the sleeve 162 through the cap 166 and opens on the side of the cap 166 in a rectangular orifice 170. The manifold 168 may be provided with a shut-off flap (not illustrated) that normally seals the orifice 170 and is moved out of position by pressurized water. See U.S. Pat. No. 6,299,075 granted Oct. 9, 2001 to Izaak Koller entitled "Self-Closing Flush Plug for Pop-Up Spinkler", the entire disclosure of which his hereby incorporated by reference. Said patent is also assigned to Hunter Industries, Inc. Any dirt or other debris is then flushed out the orifice 170 once the valve is turned ON. Thereafter the flush plug 160 is replaced with the cylindrical flow stop 122 so that the sprinkler 30 can operate normally.

While we have described and illustrated several embodiments of a pop-up sprinkler with an improved adjustable arc nozzle in detail, it should be apparent to those skilled in the art that our invention can be modified in arrangement and detail. For example, there may be more or less ports that distribute water to the landscape. They may each be of different configurations including size, shape and angle of trajectory. There may be more or less nozzle inserts, or none at all. There may be more or less stream deflectors or none at all. The non-rotating arc adjustment sleeve could surround the rotating stream nozzle. The stepped pattern helix may have more or fewer steps. Therefore, the protection afforded our invention should only be limited in accordance with the following claims.

We claim:

1. A sprinkler, comprising:

a stream nozzle with a plurality of circumferentially spaced, radially extending stream forming ports;

a non-rotating arc adjustment sleeve mounted for axial movement relative to the stream nozzle to selectively block the stream forming ports to vary an arc of coverage of a plurality of streams of water ejected from the stream forming ports;

a reduction gear train with an output coupled to rotate the stream nozzle relative to the arc adjustment sleeve; and a turbine coupled to an input of the reduction gear train.

2. The sprinkler of claim 1 wherein the stream nozzle and the arc adjustment sleeve are both cylindrical and the arc adjustment sleeve is mounted within the stream nozzle.

3. The sprinkler of claim 1 and further comprising a flush plug that can be temporarily mounted inside the arc adjustment sleeve.

4. The sprinkler of claim 1 and further comprising a flow stop mounted for manual movement to increasingly restrict an amount of water that can flow through the stream forming ports to adjust a radius of the streams of water ejected from the stream forming ports.

5. The sprinkler of claim 1 and further comprising a riser that encloses the reduction gear train and the turbine.

6. The sprinkler of claim 5 and further comprising a nozzle head rotatably mounted at an upper end of the riser and housing the stream nozzle and the arc adjustment sleeve.

7. The sprinkler of claim 6 and further comprising a stationary hub connected to the arc adjustment sleeve and fastened to an upper end of the riser below the nozzle head.

8. The sprinkler of claim 7 and further comprising an adjusting ring mounted on the stationary hub and manually rotatable to adjust the arc of coverage.

9. The sprinkler of claim 7 and further comprising a threaded pattern base cup that can be rotated by the adjusting ring to axially move the arc adjustment sleeve.

10. The sprinkler of claim 1 and further comprising a nozzle cap mounted above the rotating stream nozzle and including a plurality of downwardly extending stream diffuser pins positioned to intercept corresponding ones of the streams of water.

11. The sprinkler of claim 1 wherein the arc adjustment sleeve has a step pattern including a plurality of upper edge surfaces that terminate at different elevations.

12. The sprinkler of claim 1 wherein the arc adjustment sleeve has a sloped pattern including an inclined upper edge surface.

13. A pop-up adjustable arc and adjustable radius barrel head rotary stream sprinkler, comprising:

a cylindrical outer body;

a riser telescopically received within the outer body;

a coil spring surrounding the riser and biasing the riser to a lower retracted position within the outer body;

a nozzle head rotatably mounted at an upper end of the riser;

a cylindrical stream nozzle mounted in the nozzle head, the stream nozzle having a plurality of circumferentially spaced, radially extending stream forming ports;

a non-rotating cylindrical arc adjustment sleeve mounted for axial movement within the stream nozzle so that an upper edge of the arc adjustment sleeve with different elevations can selectively block the stream forming ports to vary an arc of coverage of a plurality of streams of water ejected from the stream forming ports;

a reduction gear train mounted in the riser with an output coupled to rotate the stream nozzle relative to the arc adjustment sleeve; and a turbine mounted in the riser and coupled to an input of the reduction gear train.

14. The sprinkler of claim 13 and further comprising a flow stop mounted in the nozzle head for manual movement from a top side of the nozzle head to increasingly restrict an amount of water that can flow through the stream forming ports to adjust a radius of the streams of water ejected from the stream forming ports.

15. The sprinkler of claim 13 and further comprising a stationary hub connected to the arc adjustment sleeve and fastened to an upper end of the riser below the nozzle head.

16. The sprinkler of claim 15 and further comprising an adjusting ring mounted on the stationary hub and manually rotatable to adjust the arc of coverage.

17. The sprinkler of claim 16 and further comprising a threaded pattern base cup that can axially move the arc adjustment sleeve by rotating by the adjusting ring.

18. A sprinkler, comprising:

a cylindrical stream nozzle with a plurality of circumferentially spaced, radially extending stream forming ports;

a non-rotating cylindrical arc adjustment sleeve mounted for axial movement within, and relative to, the stream nozzle to selectively block the stream forming ports to vary an arc of coverage of a plurality of streams of water ejected from the stream forming ports;

a flow stop mounted for manual movement to increasingly restrict an amount of water that can flow through the stream forming ports to adjust a radius of the streams of water ejected from the stream forming ports;

a reduction gear train with an output coupled to rotate the stream nozzle relative to the arc adjustment sleeve;

a turbine coupled to an input of the reduction gear train;

a riser that encloses the reduction gear train and the turbine;

a nozzle head rotatably mounted at an upper end of the riser and housing the stream nozzle and the arc adjustment sleeve;

a stationary hub connected to the arc adjustment sleeve and fastened to an upper end of the riser below the nozzle head; and an adjusting ring mounted on the stationary hub and manually rotatable to adjust the arc of coverage.

19. The sprinkler of claim 18 and further comprising a threaded pattern base cup that can axially move the arc adjustment sleeve by rotating by the adjusting ring.

20. The sprinkler of claim 18 and further comprising a nozzle cap mounted above the rotating stream nozzle and including a plurality of downwardly extending stream diffuser pins positioned to intercept corresponding ones of the streams of water.

21. A sprinkler, comprising:

a ring-shaped nozzle with a plurality of radially extending stream forming ports, the nozzle having a central bore in which is located a normally stationary cylindrical arc adjustment sleeve having a circular upper edge with different elevations around a circumference of the upper edge, a nozzle head enclosing the nozzle and the arc adjustment sleeve, an adjusting member mounted in the nozzle head, and a threaded coupling that permits manual rotation of the adjusting member to move the arc adjustment sleeve axially so that the different elevations of the upper edge of the arc adjustment sleeve can selectively block the stream forming ports to vary an arc of coverage of a plurality of streams of water as they are simultaneously ejected from the stream forming ports.

* * * * *